United States Patent [19]

Ritter

[11] Patent Number: 4,749,050

[45] Date of Patent: Jun. 7, 1988

[54] IMPACT TOOL FOR TUNNELING

[76] Inventor: Lester L. Ritter, P.O. Box 6848, Mesa, Ariz. 85206

[21] Appl. No.: 14,548

[22] Filed: Feb. 13, 1987

[51] Int. Cl.[4] ..... E21B 11/02

[52] U.S. Cl. ..... 175/19; 175/21; 175/390; 173/125

[58] Field of Search ..... 175/19, 21, 62, 389, 175/390, 414, 417, 418; 173/91, 125, 127, 136, 138

[56] References Cited

U.S. PATENT DOCUMENTS

| | | | |
|---|---|---|---|
| 955,729 | 4/1910 | Welsh | 175/21 X |
| 1,005,770 | 10/1911 | Clark | 175/21 X |
| 3,885,638 | 5/1975 | Skidmore | 175/390 |
| 4,144,941 | 3/1979 | Ritter | 175/19 |
| 4,250,972 | 2/1981 | Schmidt | 175/19 X |
| 4,280,573 | 7/1981 | Sudnishnikod et al. | 175/418 |

*Primary Examiner*—Stephen J. Novosad
*Assistant Examiner*—William P. Neuder
*Attorney, Agent, or Firm*—Paul L. Sjoquist

[57] ABSTRACT

An impact tool having an air-operated hammer for impacting against an anvil in the body of the tool to cause the tool to tunnel through the ground and having passages and conduits opening to the front tip of the tool to pass water to lubricate the tool to ease the passage of the tool through the soil during the propulsion of the tool, the front tip further having a headpiece through which the passages open to the tool exterior surface.

11 Claims, 1 Drawing Sheet

IMPACT TOOL FOR TUNNELING

BACKGROUND OF THE INVENTION

The present invention relates to apparatus for tunneling holes through the ground, as for example air-operated impact devices for tunneling substantially horizontally for the purpose of laying cables or pipes beneath roadbeds or other surface structures.

Air-operated impact devices are commonly used for horizontal tunneling beneath roadbeds or other surface structures and are constructed similar to the device described in my earlier U.S. Pat. No. 4,144,941, issued on Mar. 20, 1979. In the typical operating environment for this type of device, an excavation must be dug to a sufficient depth at the point where the hole tunneling operation is to begin. A second excavation is dug at the desired exit point of the tunneling device, again to a depth sufficient to permit the device to cleanly exit from the ground. After these excavations have been prepared, the tunneling device is carefully placed at the proper depth in the first excavation and is carefully aligned in both a horizontal and vertical plane toward the second excavation. The device is then activated to enter the ground and begin tunneling toward the second excavation. After a period of time, which is dependent upon the depth of tunneling, soil material and condition, length of tunnel and other factors, the device will travel underground in a direction generally aligned with its initial position until it exits from the ground at the second excavation.

Boring devices such as drills, wherein the soil is removed from the ground during drilling, operate differently than impact devices, which form a tunnel by compacting the soil around the device. The hammers of impact devices typically reciprocate at rates approaching sixty times per second, so that each impulse causes a small forwardly directed motion. The tip of the impact device is usually conically shaped, from a narrow front and expanding to a rear dimension which approximates the desired diameter of the hole. As the tip moves forward, the surrounding layer of soil is compacted around the tunnel.

One of the significant problems encountered with the use of impact devices is the length of time necessary to complete the tunnel. This occurs primarily where the soil is highly compacted or dense. In this situation the increased resistance to expansion of the hole delays the forward movement of the device through the soil. The amount and nature of resistance encountered by the impact device also directly affects the operator's ability to direct the impact device in a generally straight line. By decreasing the resistance of the soil to the impact device tip, the impact device will move faster and in a generally straight line toward the second excavation.

SUMMARY OF THE INVENTION

An object of the invention is to provide an impact device for tunneling beneath surface structures wherein the resistance of the soil to the impact device is decreased.

Another object of the invention is to provide a forward tip for an impact device wherein the soil surrounding the impact device will be lubricated and more easily compacted.

The present invention consists of an impact device operating generally in the manner described in my prior patent, U.S. Pat. No. 4,144,941, issued on Mar. 20, 1979.

Additionally, my present invention is capable of wetting the soil surrounding the forward end of the impact device, thereby reducing the impact resistance of the soil. The cylinder portion of the impact device consists of an elongate outer housing and a threaded front extension upon which a conically-shaped front tip is attached. A plurality of raised buttons are spaced about the forward end of the housing to assist in the tunneling operation of the invention. The forward end of the front tip has a headpiece mounted thereon which has a discontinuous shoulder and neck section for providing an annular spaoe about the front tip for injecting water. The headpiece has fluid outlets opening into this annular space, through which water or other liquids may be released to lubricate the front tip.

The outer housing of the cylinder encloses a reciprocating piston which has a hammer section at its front end. In operation, the hammer contacts an anvil located on the interior front end of the cylinder to propel the impact device forwardly through the soil. The headpiece is shaped to protect the fluid outlets from being plugged by dirt and provides a weighted end for increasing the force of each impact with the soil.

An advantage of the present invention is that the cylinder tip may be adapted for use on a wide variety of impact devices.

BRIEF DESCRIPTION OF THE DRAWINGS

A preferred embodiment of the invention is disclosed hereinafter, with reference to the appended drawings, in which.

DESCRIPTION OF THE PREFERRED EMBODIMENT

Figure 1:
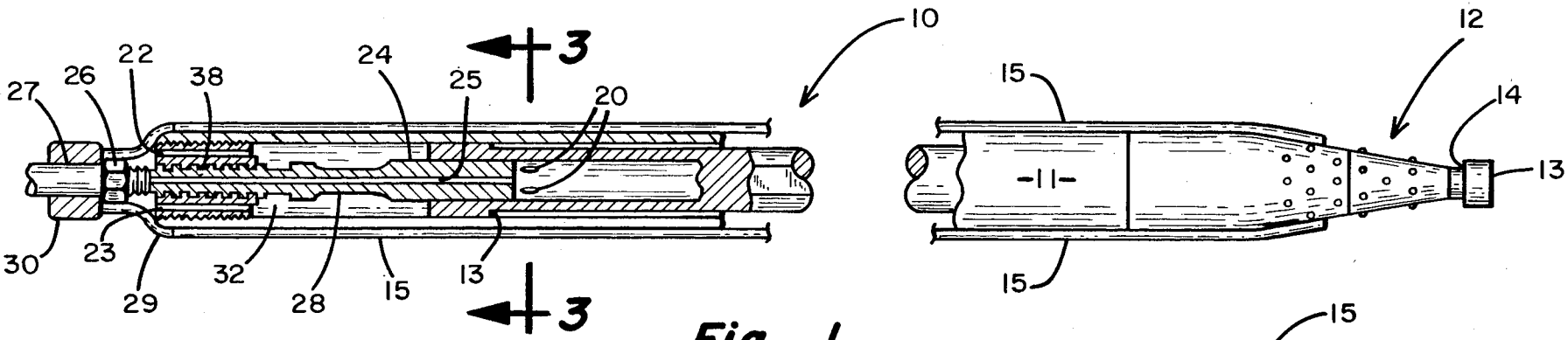
FIG. 1 illustrates the apparatus in plan view and partial cross section.

One form of the impact device is illustrated by the drawings and is described herein as 10. The impact device 10 consists of an elongate cylinder 11 having a closed, conically shaped front tip 12 and enlarged headpiece 13 threaded on the front end of the cylinder 11. A plurality of raised, hemispherical buttons **12*a* are spaced about the exterior surface of front tip 12, to assist in the operation of the invention. A plurality of rearwardly directed fluid outlets 14 are positioned immediately behind the headpiece 13 on the front end of the front tip 12. The outer surface of the cylinder 11 includes fluid conduits 15 which communicate with internal passages 16 located in the front tip 12. Passages 16 communicate with a central passage 35 which opens into an interior chamber 40 in front tip 12 to release fluid through the fluid outlets 14**.

The interior of the cylinder 11 includes an anvil 17 and a reciprocable piston 18. The piston 18 is slidably mounted within cylinder 11 and is hollow along part of its interior axial length, but has a solid front piece which comprises a hammer 19. Near the rear end of piston 18 are a plurality of ports 20 which open through flat surfaces 21 formed along the outside surface of piston 18. The rear end of the cylinder is threaded to accept an end cap 22 The end cap 22 has longitudinal ports 23 for permitting the exhausting of compressed air from within cylinder 11 in a manner hereinafter described.

A spool 24 is positioned in slidable relation with the interior surface of the piston 18. The spool 24 has a bore 25 drilled along its axial length which comprises a passage for compressed air into the interior of the impact device 10 and piston 18 via coupler 26 and air hose 27. The rear end of the spool 24 is threadable through the end cap 22 and includes a narrowed diameter 28 immediately forward of the end cap 22. The hose coupler 26 is designed for attachment to a suitable high pressure air hose 27 and when secure attachment is made, it is possible to twist the attached air hose 27 and cause the spool 24 to be threadably engaged or disengaged relative to cylinder 11, thereby causing the front end of spool 24 to move axially within cylinder 11.

The conical portion at the front end of cylinder 11 includes a threaded bore to which may be attached a threaded rear extension 34 of the front tip 12. The threaded extension 34 includes a central bore 35 which communicates with the fluid passages 16 to enable fluid to flow from the fluid conduits 15 on cylinder 11 to the fluid outlets 14. In the preferred embodiment there are four equally spaced fluid outlets 14.

Figure 2:
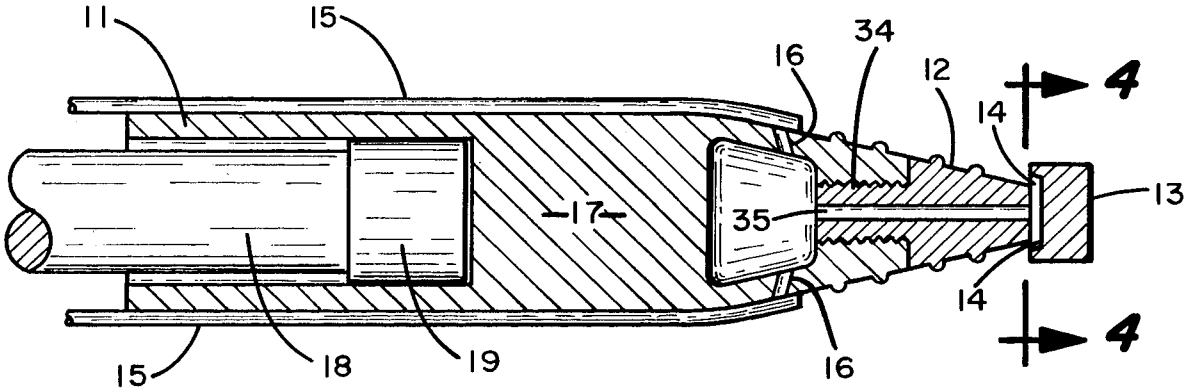
FIG. 2 illustrates an enlarged view of the front of the invention cross-section.

Fluid conduits 15 are affixed against the outside surface of cylinder 11, and each fluid conduit 15 has a front opening sealably connected into a passage 16, and a rear opening sealably connected into a manifold or fluid coupler 29. The fluid coupler 29 is designed for attachment to a suitable fluid hose 30, to permit fluid, preferably water, to flow through the fluid conduits 15 and fluid passages 16 to the fluid outlets 14 located on the front tip 12 as shown in FIG. 2. The fluid hose 30 is preferably connected to an adjustable fluid pump to provide an adjustable fluid supply for controlling the lubrication of the front tip 12.

As an alternative construction the fluid hose 30 could be carried inside of air hose 27 and be coupled to a rotatable liquid coupler and seal affixed to the rear of cylinder 11 in the proximate position of fluid coupler 29. As a further alternative construction, the fluid conduits 15 could be constructed in the form of elongate passages through the outer wall of cylinder 11 and along the length of cylinder 11.

Figure 3:
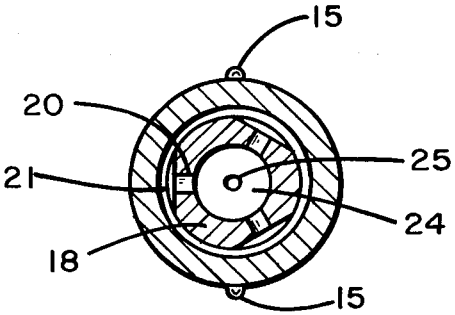
FIG. 3 illustrates the view taken along lines 3—3 of FIG. 1.

FIG. 3 illustrates a view taken along lines 3—3 of FIG. 1, wherein the location of the ports 20 is shown. Each port 20 is positioned to open on a flat surface 21 of the piston 18. The ports 20 provide air communication paths between the interior and exterior of the piston 18. The ports 20 may be covered by the spool 24 during at least a portion of the piston 18 travel distance over the spool 24, and may be uncovered during a further travel portion of piston 18. In the view shown in FIG. 2, the piston 18 is in its forwardmost position, where the ports 20 are uncovered from the spool 24. In its rearmost position, the piston 18 slides rearward over the spool 24 and the ports 20 are uncovered by the narrowed diameter 28 of spool 34. At intermediate positions the ports 20 are blocked by the larger diameter of the spool 24.

Figure 4:
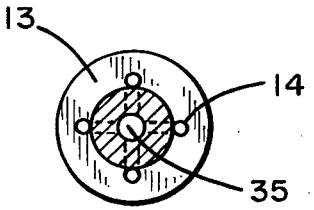
FIG 4 is a cross section taken along lines 4—4 of FIG. 2.

FIG. 4 shows a cross-sectional view taken along the lines 4—4 of FIG. 2. The fluid outlets 14 open through the exterior surface of front tip 12, and are preferably arranged to face rearwardly toward the conical surface so as to provide a directional fluid flow which permits the surface of front tip 12 to become bathed in fluid. The external openings of fluid outlets 14 are preferably arranged behind an enlarged nose or front piece, so as to create a void to freely permit the flow of fluid onto the external surface of front tip 12 In practice, a plurality of fluid outlets 14 are preferred, arranged more or less uniformly about the front tip 12 so as to provide a uniform flow of fluid. Fluid outlets 14 are all coupled to central bore 35 so as to provide a common fluid flow path to all such outlets.

In operation, compressed air is applied via the air pressure hose 27 attached to the coupler 26. The compressed air passes through the bore 25 to the interior of piston 18 and exerts a forward driving force against the piston 18. This force causes the piston 18 to move sharply ahead, contacting the hammer 19 against the anvil 17. At its forwardmost position, the piston 18 uncovers the ports 20 and the internally pressurized air is vented to the exterior of the piston 18. This vented pressurized air passes through the openings created by flat surfaces 21 on the exterior surface of piston 18, and inside the interior of cylinder 11, and acts upon the rear inner piston surface 31 to sharply drive the piston 18 in a rearward direction. The piston 18 proceeds rearward until the ports 20 again become uncovered by the narrowed diameter 28 of the spool 24. At this point, the compressed air between the piston 18 and the interior surface of cylinder 11 is vented into the rear chamber 32, and then out the longitudinal ports 23 through the end cap 22. When the piston 18 is in its rearward position, compressed air entering via the bore 25 again acts to drive the piston 18 forwardly to repeat the cycle.

Each time the hammer 19 contacts the anvil 17, the headpiece 13 on the front tip 12 is forced forwardly into the soil. As the headpiece 13 moves through the soil, fluid may be released from the fluid outlets 14, thereby lubricating the conical surface 33 and the soil at a point behind the headpiece 13 to decrease the resistance of the soil to the front tip 12 as the hole is enlarged. The fluid outlets 14 are angled rearwardly to promote the lubrication of the conical surface 33 and to reduce the possibility of becoming clogged by dirt. The hemispherical buttons **12*a* are believed to assist in the forward motion of tool 10**, both by providing compression points against the adjacent soil and by providing voids along the external conical surface to ease the flow of lubricating water over the surface.

The spool 24 may be threadably moved along its axis in either direction, thereby varying the stroke range of the apparatus. For example, if spool 24 is positioned in its forward axial position as shown in FIG. 1, the stroke of the piston 18 causes the hammer 19 to sharply contact the anvil 17, and produce a forward driving impulse. Conversely, if the spool 24 is threaded toward the end cap 22, the stroke of the piston 18 may be shifted so as to prevent any contact between the hammer 19 at the anvil 17. If the spool 24 is fully retracted toward the end cap 22, the stroke of the piston 18 may be adjusted so as to cause contact between the rear outer piston surface 36 against the end cap 22, to create a reverse impulse and cause the apparatus to move in a rearward direction.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In an impact device for tunneling through the ground, having an elongate cylinder with an air reciprocable piston and hammer therein and means for reciprocating said piston and hammer to cause forwardly or rearwardly impacting against respectively front and rear ends of said cylinder, the improvement comprising an end piece attacheable to the front end of said cylinder, said end piece having an interior chamber and passages communicating between said interior chamber and the outside surface of said end piece; said outside surface comprising a forwardly narrowing taper joined to an enlarged front end, wherein said enlarged front end has a rearwardly facing surface bridging to said taper, and said passages open to the outside surface of said end piece through said rearwardly facing surface; at least one fluid conduit along said elongate cylinder, said at least one fluid conduit being coupled into flow communication with said interior chamber, and having a rear opening proximate the rear end of said cylinder; and means for coupling a source of fluid to said fluid conduit rear opening.

2. The apparatus of claim 1, wherein said rearwardly facing surface further comprises a discontinuous external surface portion, and said passages open into said surface portion.

3. The apparatus of claim 2, further comprising interior passages in the front end of said cylinder, said interior passages communicating at one end with said at least one fluid conduit and communicating at another end with said interior chamber.

4. The apparatus of claim 3, further comprising a threaded extension projecting forwardly from the front end of said cylinder with said interior cylinder passages passing therethrough, and threaded attachment means in said end piece for receiving said threaded extension.

5. The apparatus of claim 4, said end piece further comprises a tapered external surface narrowing toward the front end of said end piece, said tapered surface having a plurality of raised hemispherical bottoms spaced thereon.

6. An impact device for tunneling through the ground, comprising (a) a cylinder having inner and outer surfaces and front and rear ends, said front end of the cylinder having a front tip;

(b) said cylinder having a reciprocable hammer therein, being in contacting relation with an anvil on said inner surface of said cylinder;

(c) a headpiece attached to said cylinder front tip, said headpiece having fluid passages therein which open to an exterior surface of said headpiece; said headpiece exterior surface comprising a forwardly narrowing taper joined to an enlarged front end through a rearwardly facing joining surface, said fluid passages opening through said joining surface; and (d) means for coupling fluid flow to said headpiece fluid passages.

7. The apparatus of claim 6, wherein said headpiece fluid passages are positioned to direct fluid rearwardly along said front tip toward the front of said cylinder.

8. The apparatus of claim 7, wherein said fluid passages are evenly spaced about the exterior surface of said headpiece.

9. The apparatus of claim 6, further comprising fluid conduits along said outer cylinder surface in flow communicating relation to said fluid passages.

10. The apparatus of claim 6, wherein said headpiece further comprises an enlarged front end, and a narrowed neck portion rearwardly adjacent said front end, and a rearwardly expanding conical surface extending from said narrowed neck portion to said cylinder front tip, the conical surface having a plurality of raised projections spaced thereover.

11. The apparatus of claim 6, wherein said headpiece is removably attached to the front tip of said cylinder.

* * * * *